United States Patent [19]

French

[11] 4,179,088

[45] Dec. 18, 1979

[54] OFFSET BEACON HOMING

[75] Inventor: John A. French, Huntsville, Ala.

[73] Assignee: The United States of America as represented by the Secretary of the Army, Washington, D.C.

[21] Appl. No.: 742,407

[22] Filed: Nov. 17, 1976

[51] Int. Cl.[2] ..... F41G 7/14; F41G 9/00; F41G 7/00; F41G 11/00

[52] U.S. Cl. ..... 244/3.19; 244/3.14

[58] Field of Search ..... 244/3.15, 3.19, 3.14

[56] References Cited

U.S. PATENT DOCUMENTS

| | | | |
|---|---|---|---|
| 3,156,435 | 11/1964 | Norton et al. | 244/3.14 |
| 3,567,163 | 3/1971 | Kepp et al. | 244/3.14 |
| 3,698,811 | 10/1972 | Weil | 244/3.19 |
| 3,715,953 | 2/1973 | Allan | 244/3.16 |
| 3,731,892 | 5/1973 | Cantella et al. | 244/3.16 |
| 3,743,215 | 7/1973 | Harris | 244/3.19 |
| 3,778,007 | 12/1973 | Kearney et al. | 244/3.14 |
| 3,844,506 | 10/1974 | Stavis et al. | 244/3.19 |
| 3,902,684 | 9/1975 | Queeney | 244/3.14 |

*Primary Examiner*—Samuel W. Engle
*Assistant Examiner*—Thomas H. Webb
*Attorney, Agent, or Firm*—Nathan Edelberg; Robert P. Gibson; Harold W. Hilton

[57] ABSTRACT

A system for enabling homing by a missile onto a target which is marked by a beacon at some other location. A radio frequency beacon is located remotely from the intended target. Target coordinates relative to the beacon are obtained and relayed by conventional means to the launch site and are stored in missile memory. During flight the missile seeker acquires, interrogates and tracks the beacon. The missile borne equipment generates guidance signals which alter the trajectory to the target location.

2 Claims, 3 Drawing Figures

OFFSET BEACON HOMING

DEDICATORY CLAUSE

The invention described herein may be manufactured, used and licensed by or for the Government for governmental purposes without the payment to me of any royalties thereon.

BACKGROUND OF THE INVENTION

Homing on beacons is an old trick, often used to prove out a seeker under some particular set of circumstances. There has often been a flurry of interest in the Army in such things as planted beacons, but most cases are direct homing and not the offset homing considered here. By offset homing, it is meant that the seeker points at or otherwise gets its guidance information from the beacon radiations but the missile guides to some other point in space. Some thought has been given to using two or more beacons and triangulating or trilaterating to compute a target fix. Other methods such as illuminating the target (e.g. laser semi-active) or command guidance are technically different than offset homing and each has its place. It is considered that a single beacon that is simple in nature can be used to enable missile homing on a target some distance away, provided that suitable information is provided to the missile to reference the target's coordinates, relative to the beacon's coordinates.

SUMMARY OF THE INVENTION

A key relationship is that a missile located at the target intercept point with a seeker aiming at a beacon or transponder would have seeker spatial angle coordinates the inverse of that of an observer stationed at the beacon, looking at the target. In addition the range coordinates will be equal. For example if the observer (with a beacon) detects the target at 181° azimuth and +3° in elevation angle and one kilometer in range, the seeker must point 001° in azimuth, −3° in elevation and be one kilometer away from the beacon, to have correctly and completely solved the offset beacon homing problem.

In principle this can be achieved by the following method. An agent has observed a ground target which he wishes to mark for intercept. He determines a suitable beacon location and determines the target azimuth, range and elevation, relative to the beacon site. This may be accomplished by a device such as a surveying instrument with a laser range finder which is referred to as a target designator. The beacon is emplaced and activated. The agent communicates the following to the missile launch site: (a) the beacon's geographic coordinates, (b) the target's relative range, azimuth and elevation coordinates, and (c) other data such as a beacon code or frequency. The beacon is silent until interrogated by the missile in flight. Upon interrogation, the beacon responds on the seeker frequency, enabling the seeker to locate and track the beacon. Seeker coordinates are compared with the inverse of the target coordinates that have been stored in missile memory. The missile guides in such a direction as to reduce to zero the differences in the three sets of coordinates, simultaneously. When the coordinate differences reach zero, the missile is at the target and fuzing can be proximity, contact or by computer.

This invention can be better understood from the following detailed description taken in conjunction with the accompanying drawing.

DESCRIPTION OF THE PREFERRED EMBODIMENT

Figure 1:
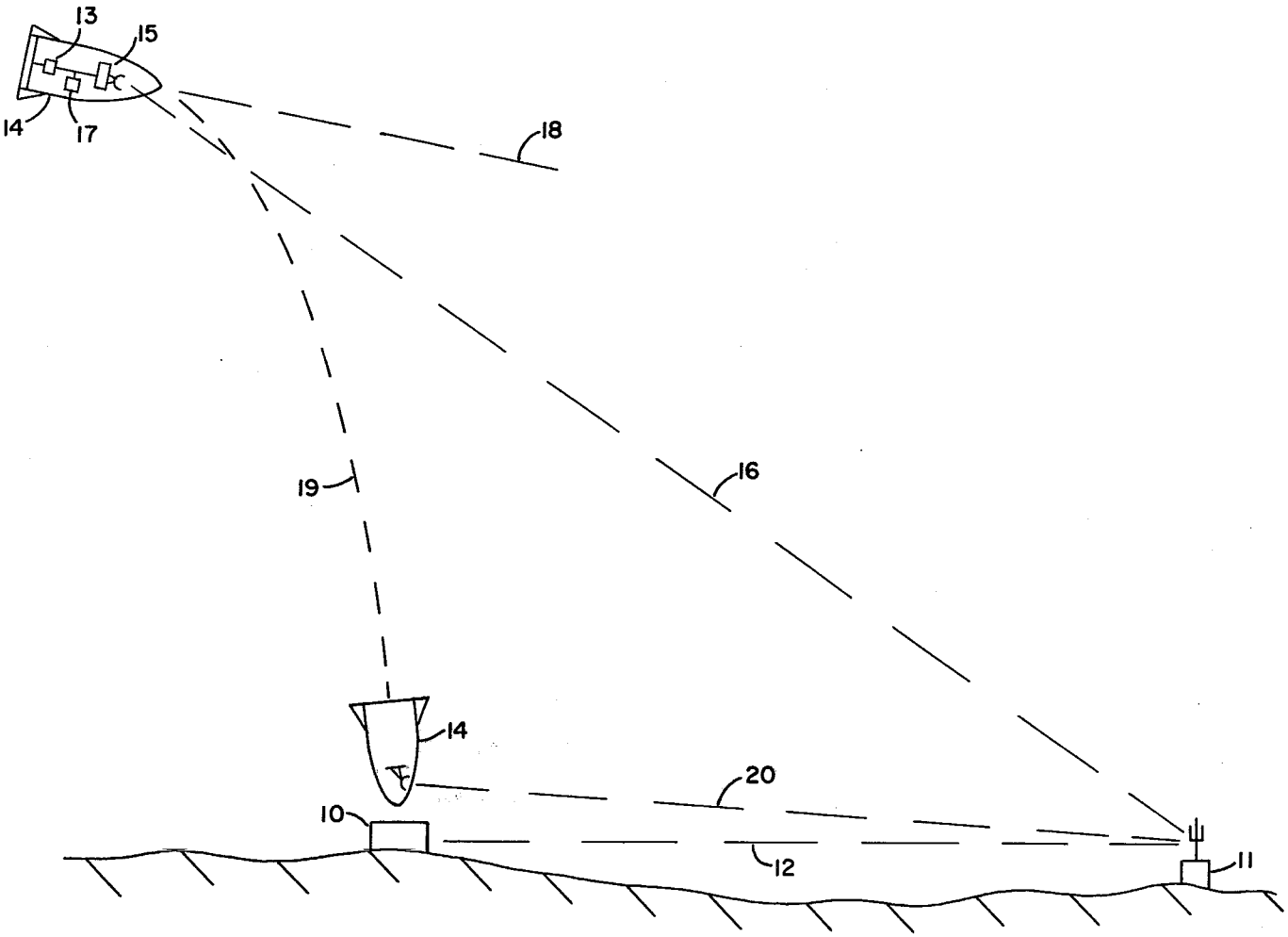
FIG. 1 is a view illustrating the operation of the present invention.

As seen in FIG. 1 a target 10 is identified and designated for destruction. A radio frequency beacon 11 is emplaced a known distance and direction from the target as indicated by dashed line 12. This known information is inserted, prior to launch, into the guidance computer 13 in the missile 14. During missile flight a seeker 15 in the missile acquires and tracks the beacon radiations, by orientation of its antenna along the dashed line 16. By radar ranging, the distance to the beacon along line 16 is determined.

The missile is equipped with an inertial reference platform 17 which establishes vertical and horizontal directions in flight. The seeker antenna's spatial coordinates are determined by comparison of antenna position pickoffs with the inertial reference. Simultaneously the radar range is measured and all three coordinates are sent to the computer 13 for determination of guidance commands. The computer determines a new course for the missile which deviates from its initial trajectory 18 to a new course 19 until the missile 14 approaches the target 10. The missile is determined to be nearing the target as the seeker's new tracking range and direction 20 approach the magnitude of the inverse surveyed distance and direction 12.

Figure 2:
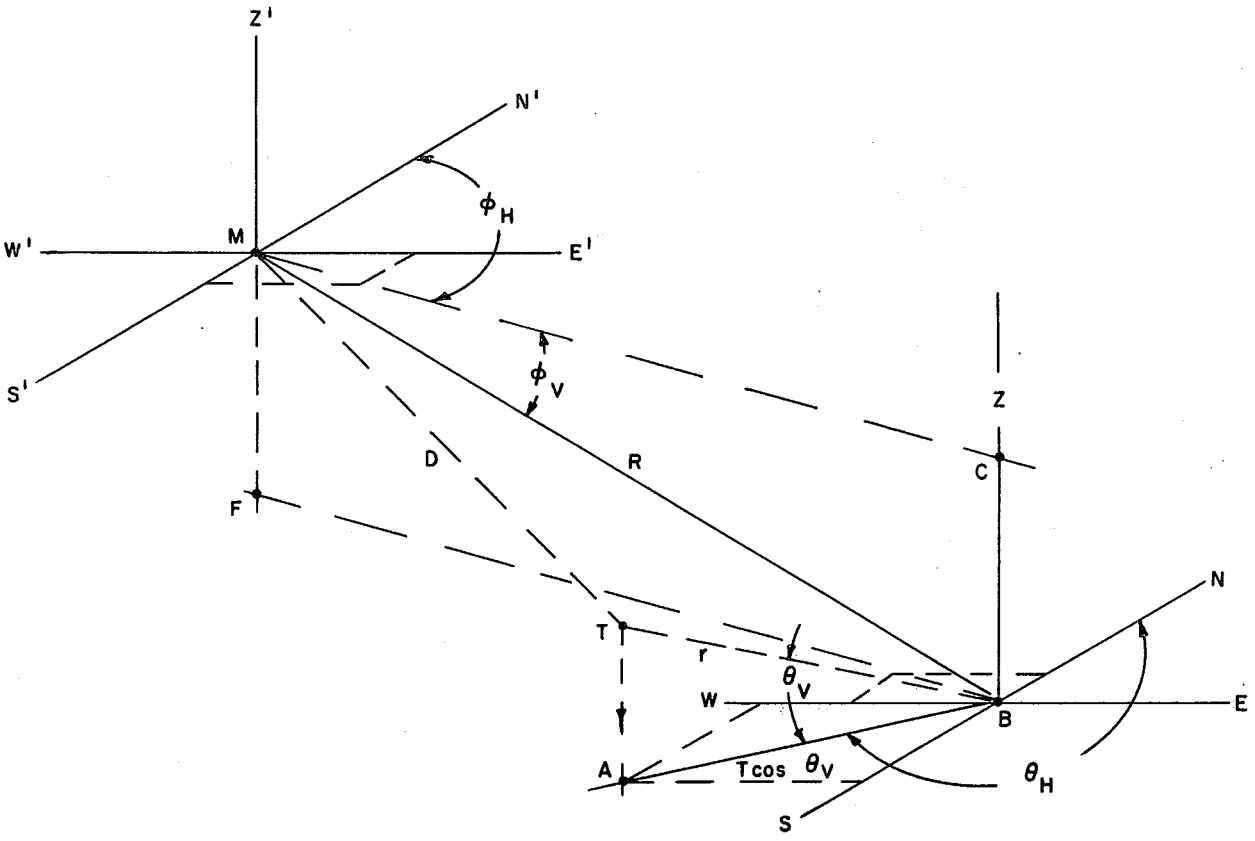
FIG. 2 is a diagrammatic view of the coordinate system.

FIG. 2 is a coordinate system diagram for describing equipment implementation. Point B is at the origin of one orthogonal coordinate system, ZNE, described as BZ (vertical); NS horizontal in the north-south direction; EW horizontal in the east-west direction. The point B is in optical line of sight of the target, T. For clarification a point A is determined as the point T projected vertically on to the NS-EW plane. A laser ranging device or other technique is used to determine the distance, r, from the point B to T; the elevation angle, $\theta_v$, of the target relative to the NBE plane and the bearing, $\theta_H$, of the target relative to NS line in the NBE plane. $\theta_v$, $\theta_H$, r and the map coordinates of B are transmitted to the missile launcher by any convenient communication system. The $\theta_v$, $\theta_H$, and r must be precise, but the map coordinates of B need not be highly accurate. $\theta_v$, $\theta_H$ and r are stored in the missile's computer memory, as the target position coordinates relative to point B.

The beacon is emplaced at point B and its receiver activated. The military unit departs the area. The missile is launched onto a ballistic or other trajectory to the vicinity of the map coordinates of point B.

While the missile is in flight, its position is described as point M, at the center of orthogonal coordinates described as Z' (parallel to Z), N'S' (parallel to NS) and E'W' (parallel to EW). While the ZNE coordinate system was established by the target designator, the Z'N'E' coordinates are established by the inertial reference unit 17 aboard the missile 14. For clarification the Z' axis is extended to the point F, which is in the NBE plane. The distance D then becomes the distance from missile to target. The distance R is the distance from missile to beacon. The Z axis is extended to the point C, which is in the N'ME' plane.

As the missile approaches some predetermined distance from B, the missile transmits a signal to the beacon which is received, decoded and retransmitted back to the missile. By a radar ranging method the quantity R is continuously determined and updated. By direction finding techniques, the missile seeker 15 aligns itself with the direction of the beacon. The seeker's angular coordinates can now be measured as $\phi_H$ and $\phi_v$ in the Z'N'E' coordinate system, by comparison of seeker angle pickoffs with the inertial reference unit 17.

At this point in the description the distance and direction from the missile to the target along line D are unknown and must be determined to illustrate that there is sufficient information on the missile to guide the missile to the target. By geometric theorem, angle FBM equals $\phi_v$ which is a known value in the vertical plane. Likewise angle FBS is equal to $\phi_H$ which is a known value in the horizontal plane. Since the values of $\phi_v$, $\phi_H$, $\theta_v$ and $\theta_H$ are all known, the length D can be determined by the trigonometric relationship:

$$D=[(R \sin \phi_H \cos \phi_v - r \sin \theta_H \cos \theta_v)^2+(R \cos \phi_H \cos \phi_v - r \cos \theta_H \cos \theta_v)^2+(R \sin \phi_v - r \sin \theta_v)^2]^{\frac{1}{2}}$$

Figure 3:
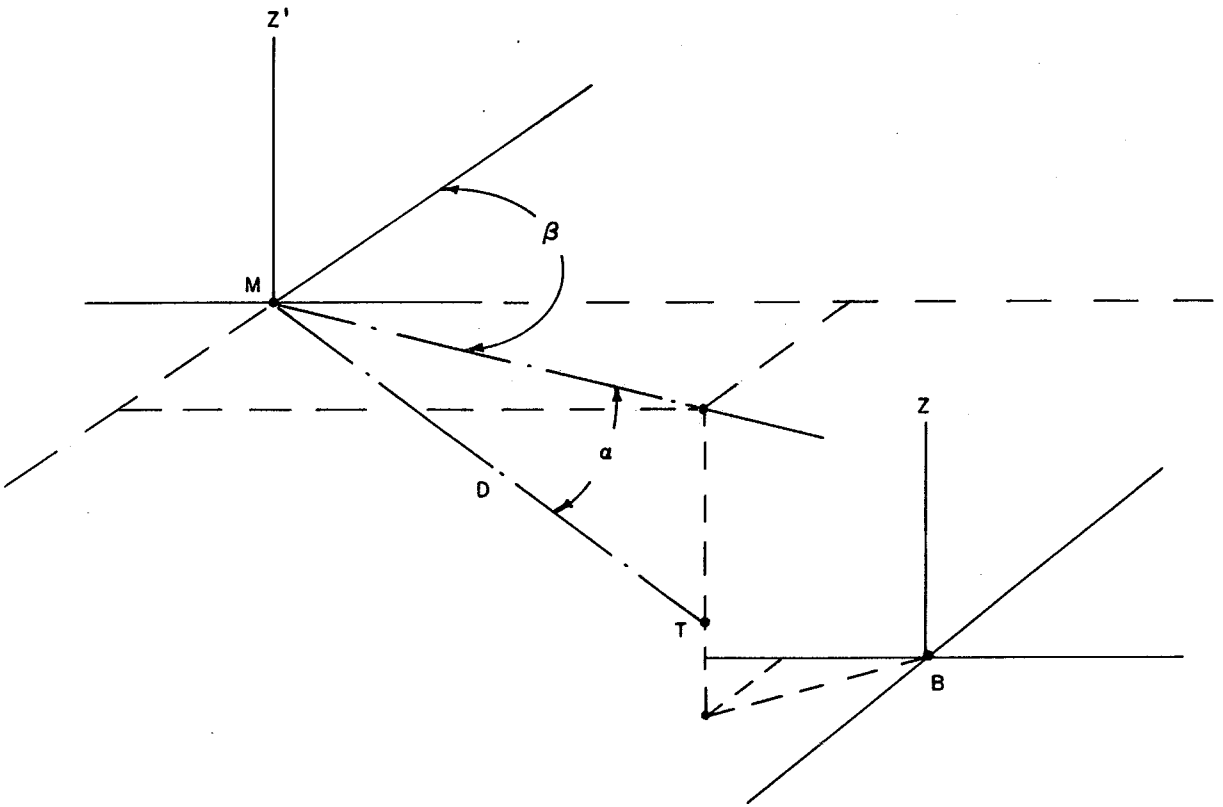
FIG. 3 is a diagrammatic view showing target angles.

Having determined the value of D, all of the parameters of the triangle MBT can be determined since the values of R and r are known and any triangle can be fully described geometrically when the three sides are known. The spatial angles of the target as viewed from the missile along line D can be described as a depression angle, $\alpha$, measured below the N'ME' plane and a target bearing angle, $\beta$, measured in the N'ME' plane, relative to the N'S' axis, (FIG. 3). From the known values determined above, these values can now be determined as follows:

$$\alpha = \cos^{-1} D^{-\frac{1}{2}}[(R \cos \phi_v \cos \phi_H - r \cos \theta_v \cos \theta_H)^2+(R \cos \phi_v \sin \phi_H - r \cos \theta_v \sin \theta_H)^2]^{\frac{1}{2}}$$

$$\beta = \sin^{-1}(R \cos \phi_v \sin \phi_H - r \cos \theta_v \sin \theta_H)\,[(R \cos \phi_v \cos \phi_H - r \cos \theta_v \cos \theta_H)^2+(R \cos \phi_v \sin \phi_H - r \cos \theta_v \sin \theta_H)^2]^{\frac{1}{2}}$$

From the above, the information is now available to the missile to describe the target's position in three dimensions, $\alpha$, $\beta$, and D, relative to the missile's position. Missile flight to this location could be by any of several conventional means. For example, the flight could be altered to guide the missile down line D at angles $\alpha$ and $\beta$, until target intercept.

Another method of missile navigation to the target does not involve the elaborate computation indicated above. A method of offset proportional navigation is described below:

Conventional proportional guidance is normally achieved by controlling the airframe heading in such a direction as to reduce the seeker's angular rates of change to approach zero. Alternatively, the airframe heading may be controlled so as to cause the seeker elevation and azimuth angles $\phi_v$ and $\phi_H$ to approach the values $-\theta_v$ and $\theta_H+180°$ respectively as the value of R approaches r. As stated previously, the achievement of this condition simultaneously by all three values amounts to a successful target intercept. A simplistic implementation would be to control the missile course so that all three coordinates were changed proportionately. For example as R−r decreases at a rate of X% per second, $\phi_H-\theta_H$ decreases X% per second, etc. Since the value of R and r are known at the initiation of homing, the initial R−r value can be used to determine appropriate navigation ratios of the guidance system, thereby causing the missile to fly any of several different trajectories from point M to T.

I claim:

1. A system for enabling homing of a missile onto a target, said target having a radio frequency beacon disposed at a remote predetermined distance and direction therefrom: a missile having computer means thereon for storing signals indicative of the distance and direction of said target relative to said beacon for storing signals indicative of the inverse of the coordinates of said target; seeker means carried by said missile for acquiring and tracking beacon radiations, said seeker means disposed for emitting signals indicative of spatial coordinates thereof responsive to acquiring and tracking said beacon radiations; said computer means disposed for comparing said signals indicative of said seeker coordinates with said inverse target coordinates and providing signals indicative of the differences in said coordinates; and, means carried on said missile for receiving said signals indicative of the differences in and coordinates for guiding said missile in a direction to reduce to zero the differences between the target coordinates and said inverse coordinates responsive to beacon emissions to home the missile onto the target.

2. A method of homing a missile, having a guidance computer thereon and a seeker responsive to a predetermined signal frequency, onto a target comprising the steps of: placing a beacon remote from a target; surveying the target area relative to the beacon to determine the geographic coordinates of said target area, said geographic coordinates being defined as azimuth, range and elevation; providing signals to said guidance computer which signals are correlative with said geographic coordinates; surveying said target area to determine the beacon's distance and direction from said target and providing signals to said guidance computer which are correlative with the beacon's distance and direction from said target; establishing control communication between said beacon and said missile whereby said beacon responds to the missile seeker frequency thereby enabling the seeker to locate and track the beacon; and, receiving and comparing signals of the seeker coordinates with the inverse of the signals of the target coordinates stored in the computer memory until the missile is at the target.

* * * * *